US012065818B2

(12) United States Patent
Wilson et al.

(10) Patent No.: US 12,065,818 B2
(45) Date of Patent: Aug. 20, 2024

(54) UNIVERSAL TOILET ODOR REMOVAL SYSTEM

(71) Applicants: Jordon Wilson, Fort St. John (CA); Barry Wilson, Fort St. John (CA)

(72) Inventors: Jordon Wilson, Fort St. John (CA); Barry Wilson, Fort St. John (CA)

( * ) Notice: Subject to any disclaimer, the term of this patent is extended or adjusted under 35 U.S.C. 154(b) by 0 days.

(21) Appl. No.: 17/742,280

(22) Filed: May 11, 2022

(65) Prior Publication Data

US 2023/0366189 A1 Nov. 16, 2023

(51) Int. Cl.
*E03D 9/05* (2006.01)

(52) U.S. Cl.
CPC ..... *E03D 9/05* (2013.01)

(58) Field of Classification Search
CPC ..... E03D 9/05
USPC ..... 4/213
See application file for complete search history.

(56) References Cited

U.S. PATENT DOCUMENTS

| | | | | |
|---|---|---|---|---|
| 5,386,594 | A * | 2/1995 | Hilton | E03D 11/16 4/213 |
| 6,073,273 | A * | 6/2000 | Tillen | E03D 11/16 4/216 |
| 6,295,656 | B1 * | 10/2001 | Tillen | E03D 9/05 4/352 |
| 7,461,410 | B1 * | 12/2008 | Shaffer | E03D 9/05 4/209 R |
| 2002/0035749 | A1 * | 3/2002 | Prisco | E03D 9/05 4/213 |
| 2007/0000035 | A1 * | 1/2007 | Belcher | E03D 9/05 4/213 |

* cited by examiner

*Primary Examiner* — Huyen D Le

(57) ABSTRACT

An odor removal system for a toilet includes an odor intake unit, a first conduit assembly, a pump unit, a second conduit assembly and a base. The odor removal system is preferably easy installable onto any toilet and effectively removes odor particles during use of the toilet, thereby substantially preventing the odor particles from dispersing about the room and causing an unpleasant odor in the room.

20 Claims, 9 Drawing Sheets

UNIVERSAL TOILET ODOR REMOVAL SYSTEM

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of toilet accessories of existing art and more specifically relates to an odor removal system for a toilet.

RELATED ART

An unpleasant problem with the use of toilets is the odors associated therewith. As such, many attempts have been made to cover or remove these odors. For example, air fresheners have long been used in bathrooms. Whether automatic air fresheners or manual air fresheners, these means impart a pleasant scent into the ambient air in order to cover unpleasant toilet odors. However, air fresheners are not satisfactory when used alone as they only cover the unpleasant odor, meaning that the odor particles still linger in the ambient air. Other attempts have seen exhaust fans used in the bathroom to remove the odor particles; however, these exhaust fans are also not satisfactory as they are typically unable to remove a majority of the odor particles, and thus, odor remains. As such, a suitable solution is desired.

SUMMARY OF THE INVENTION

In view of the foregoing disadvantages inherent in the known toilet accessory art, the present disclosure provides a novel universal toilet odor removal system. The general purpose of the present disclosure, which will be described subsequently in greater detail, is to provide a universal system that is installable onto any toilet and effectively removes odor particles during use of the toilet, thereby substantially preventing the odor particles from dispersing about the room and causing an unpleasant odor in the room.

An odor removal system for a toilet is disclosed herein. The odor removal system may include an odor intake unit, a first conduit assembly, a pump unit, a second conduit assembly and a base. The odor intake unit may include a main body having an inlet, an outlet and an odor intake channel therebetween. The odor intake unit may be configured for attachment about a rear of a bowl of the toilet such that odor particles are directed into the inlet. The first conduit assembly may be configured to connect to the outlet of the odor intake unit and convey the odor particles therefrom. The pump unit may include a housing, a pump, an input and an output and the input may be configured for connection to the outlet of the odor intake unit via the first conduit assembly. The pump may be configured to move the odor particles in through the input and out through the output.

The second conduit assembly may be configured to connect to the output of the pump unit and convey the odor particles therefrom. The base may be configured for installation under a base of the toilet and may include a substantially flat body having a top surface opposite a bottom surface, a sewer pipe aperture, and an odor removal channel. The odor removal channel may be disposed at a side of the base and terminate at the sewer pipe aperture. The odor removal channel may be configured for connection to the output of the pump unit via the second conduit assembly such that the odor particles are directed through the odor removal channel. The sewer pipe aperture may be configured for installation in line with a sewer drainpipe such that the odor particles directed through the odor removal channel are expelled through the sewer pipe aperture and down through the sewer drainpipe.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a universal toilet odor removal system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to toilet accessories and more particularly to a universal toilet odor removal system. Generally, the universal toilet odor removal system may include an exhaust vent that is mountable to a toilet via two existing bolts used for fastening a toilet seat to the toilet. A hose may be attached to an air intake of the universal toilet odor removal system, and to a suction inlet of a pump that in turn vents toilet odors through a flange located on a base and down through a sewer pipe. Preferably, the universal toilet odor removal system is easily installable and fits on any style/size of toilet.

Figure 1:
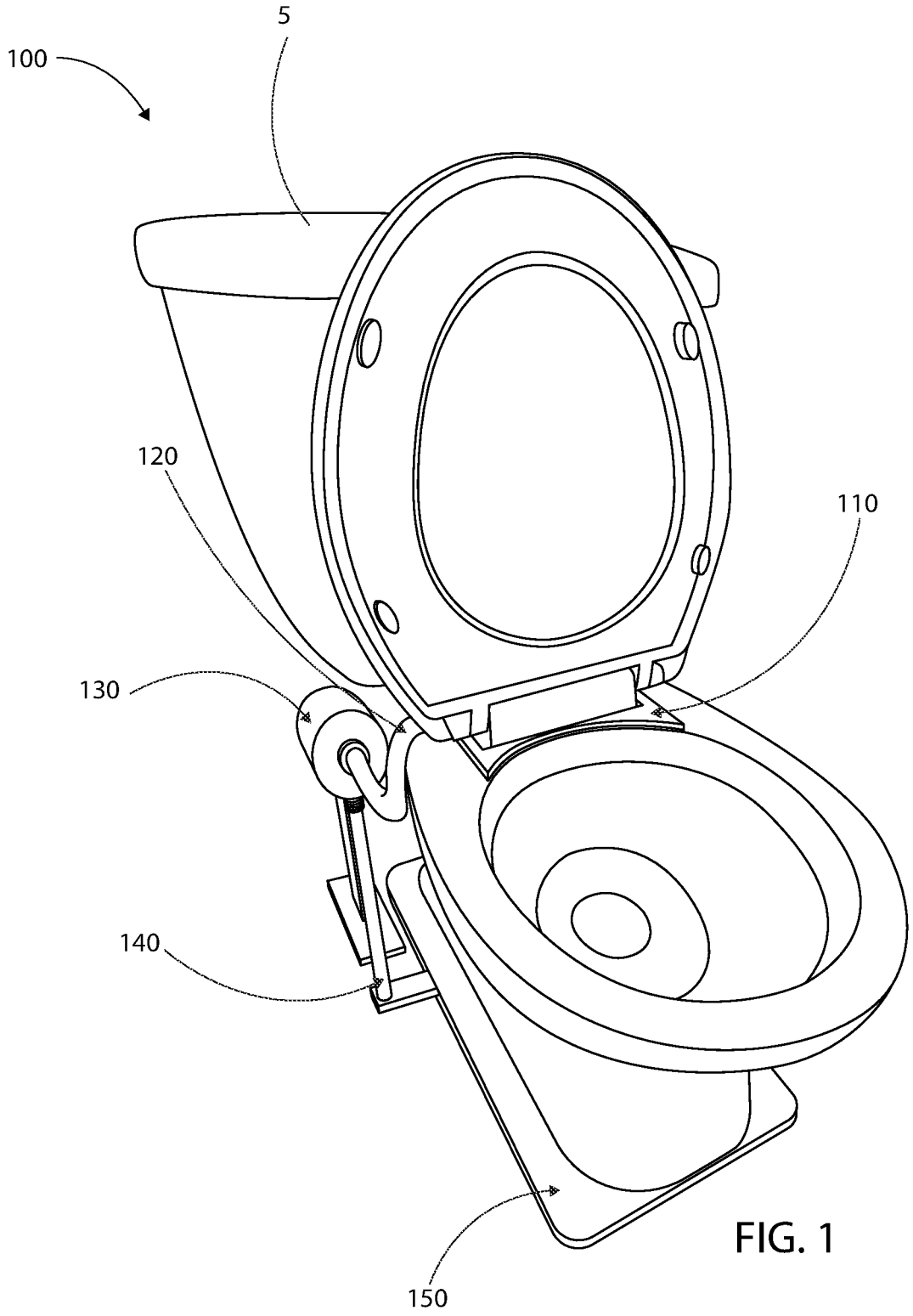
FIG. 1 is a front perspective view of an odor removal system attached to a toilet, according to an embodiment of the present disclosure.

Referring now more specifically to the drawings by numerals of reference, there is shown in FIGS. 1-12, various views of an odor removal system 100. The odor removal system 100 may be used in removing odors from a toilet 5. As such, the odor removal system 100 may be attached about the toilet 5. In some embodiments, as shown in FIG. 1, the odor removal system 100 may include an odor intake unit, a first conduit assembly 120, a pump unit 130, a second conduit assembly 140, and a base 150.

Figure 2:
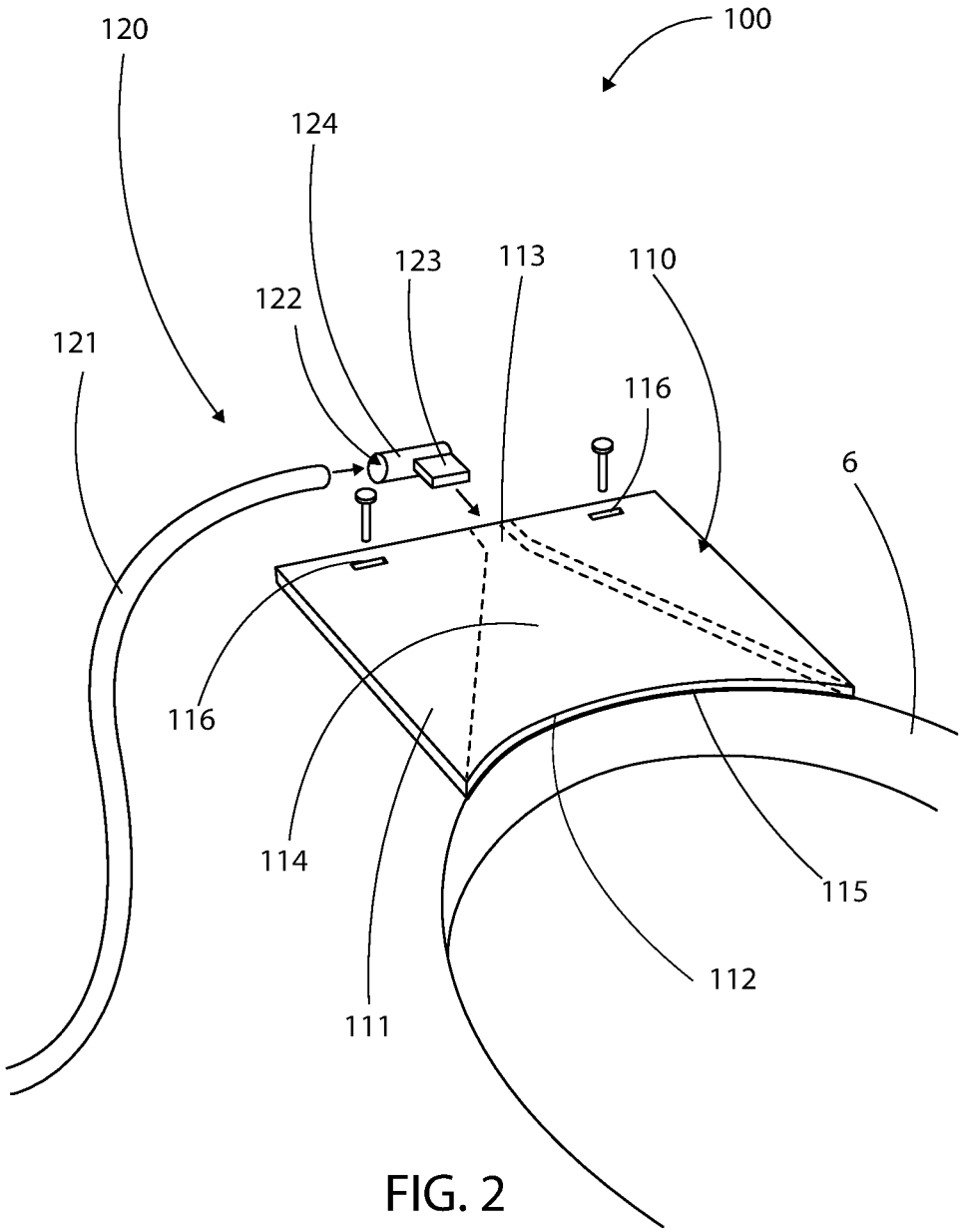
FIG. 2 is a partial exploded view of the odor removal system illustrating an odor intake unit and a first conduit assembly, according to an embodiment of the present disclosure.

As shown in FIG. 2 particularly, the odor intake unit 110 may include a main body 111 having an inlet 112, an outlet 113, and an odor intake channel 114 therebetween. The odor intake channel 114 is shown via broken lines in FIG. 2 for clarity—it should be appreciated that the main body 111 is not contemplated to be transparent. In some embodiments, the odor intake unit 110 may include a width of 180 mm, and a length of 100 mm. The odor intake unit 110 may be configured for attachment about a rear of a bowl 6 of the toilet 5 such that odor particles are directed into the inlet 112.

For example, in some embodiments, the odor intake unit 110 may attach to the toilet 5 via existing means used to attach a toilet seat to the toilet 5. As such, in some embodiments, as shown in FIG. 2, the odor intake unit 110 may include intake bolt apertures 116 configured to receive a bolt and nut combination. In some examples, a user may remove the toilet seat, attach the odor intake unit 110 with the intake bolt apertures 116 aligned with existing bolts, attach the toilet 5 seat as normal over the existing bolts, and screw nuts over the bolts to fasten. As such, the bolts may attach the toilet seat to the odor intake unit 110, and the toilet seat and the odor intake unit 110 to the toilet 5.

The inlet 112 may be disposed at a front side of the odor intake unit 110 and may span an entirely of the front side, ensuring maximum coverage of the bowl 6 in order to intake as much of the odor particles as possible. In some embodiments, as shown in FIG. 2, the front side of the odor intake unit 110 may include an arcuate shape configured to conform to the bowl 6 of the toilet 5. This may ensure the odor intake unit 110 is as discrete as possible, whilst furthering coverage of the bowl 6. In addition, the inlet 112 may include a bottom lip 115 configured to prevent inadvertent water flow therethrough (such as in the event of a toilet 5 overflow).

In some embodiments, the outlet 113 may be disposed at a rear side of the odor intake unit 110. The outlet 113 may include a smaller size than the inlet 112. For example, the outlet 113 may include a width of 20 mm. In comparison, the inlet 112 may include a width of 180 mm (again to maximize amount of odor particles captured). As such, the odor intake channel 114 may include a funnel-like configuration to funnel the odor particles into the outlet 113. As shown in FIG. 2, the first conduit assembly 120 may be configured to connect to the outlet 113 of the odor intake unit 110 and convey the odor particles therefrom. In some embodiments, the first conduit assembly 120 may include a first conduit 121 and a first fitting 122. In some examples, the first conduit 121 may include a diameter of 5 mm.

As shown in FIG. 2, the first fitting 122 may include an intake section 123 and a first conduit section 124. The intake section 123 may be configured to attach to the outlet 113 of the odor intake unit 110 and as such may guide the odor particles from the outlet 113 and into the first conduit 121. For example, the intake section 123 may insert into the outlet 113, may clip onto the outlet 113, etc. As such, the intake section 123 may include a shape similar to that of the outlet 113. For example, the outlet 113 and the intake section 123 may include a cuboidal shape. The first conduit section 124 may be configured for connection with the first conduit 121. Similarly, the first conduit section 124 may include a shape similar to that of the first conduit 121; for example, both the first conduit section 124 and the first conduit 121 may include a cylindrical shape.

The pump unit 130 may include an input 132 configured for connection to the outlet 113 of the odor intake unit 110 via the first conduit assembly 120. Particularly, the first conduit 121 may attach to the first conduit section 124 at one end, and to the input 132 of the pump unit 130 at another end, as demonstrated in FIGS. 2-3. Preferably, the first conduit 121 may be flexible and able to conform to the bowl 6 of the toilet 5. The pump unit 130 may further include a pump housing 131, a pump 138, and an output 133. The pump 138 may be configured to move the odor particles in through the input 132 and out through the output 133. For example, the pump 138 may be a vacuum pump including a rotor assembly configured to suction the odor particles through the input 132 and discharge the odor particles through the output 133.

Figure 3:
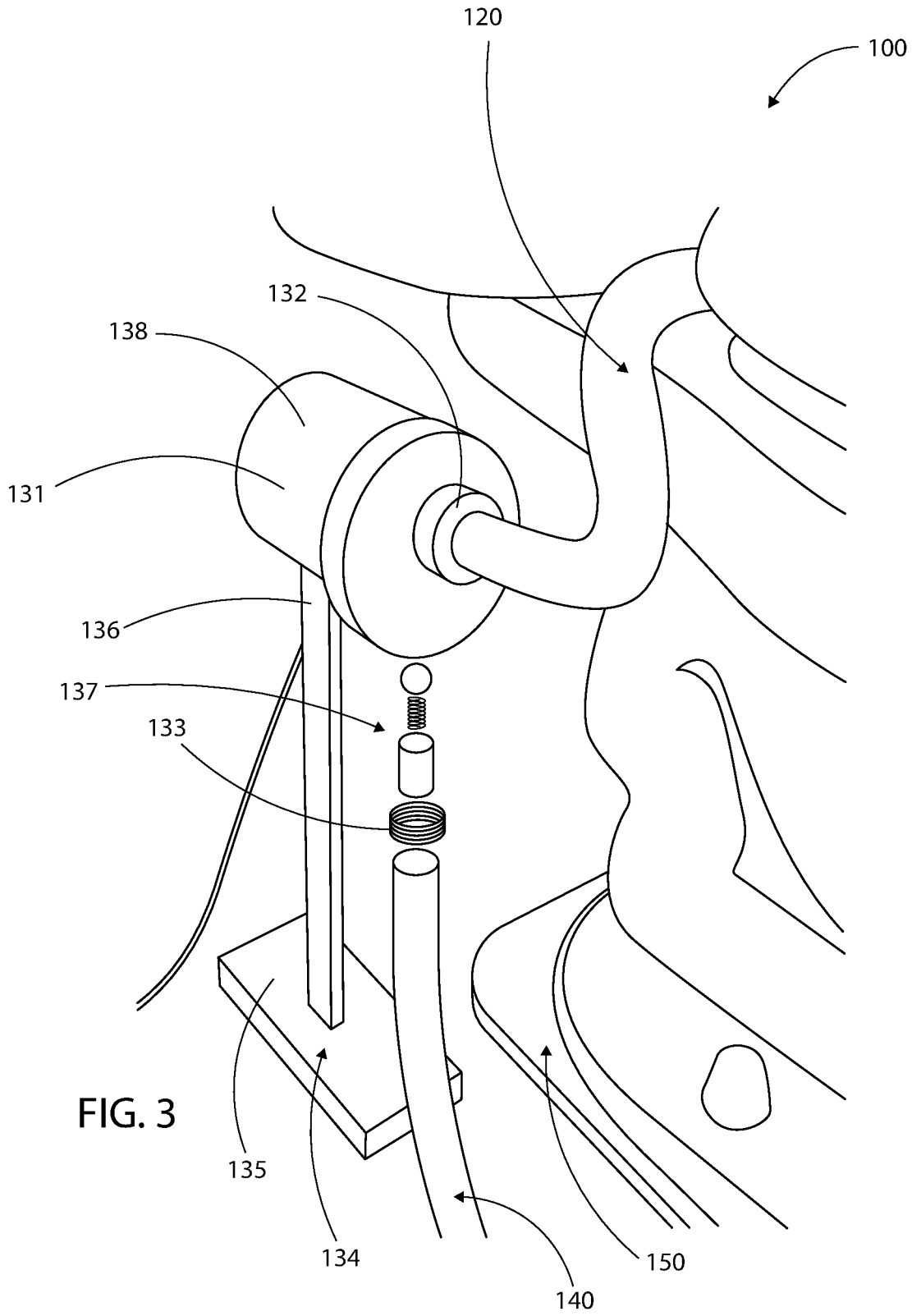
FIG. 3 is a partial exploded view of the odor removal system illustrating a pump unit and a second conduit assembly, according to an embodiment of the present disclosure.

In some embodiments, as shown in FIG. 3, the pump unit 130 may further include a check valve 137. The check valve 137 may prevent sewer backup and also may prevent odor particles from moving back into the pump unit 130. As shown, the check valve 137 may located about the output 133. In some examples, the check valve 137 may include a ball and spring combination. When the odor particles (and air) are moving through the pump unit 130 normally, the ball may be pushed into an open position; if odor particles, sewer backup, etc. tries to move back into the output 133, the ball may be pushed into an opening of the output 133 (into a closed position) and thereby prevent the odor particles, sewer backup, etc. from moving into the pump unit 130. It should be appreciated that the check valve 137 is not limited to a particular configuration, however. For example, in some embodiments, the check valve 137 may be a flapper/swing check valve including a flapper for controlling flow of the odor particles. Other check valves may also be contemplated.

Figure 4:
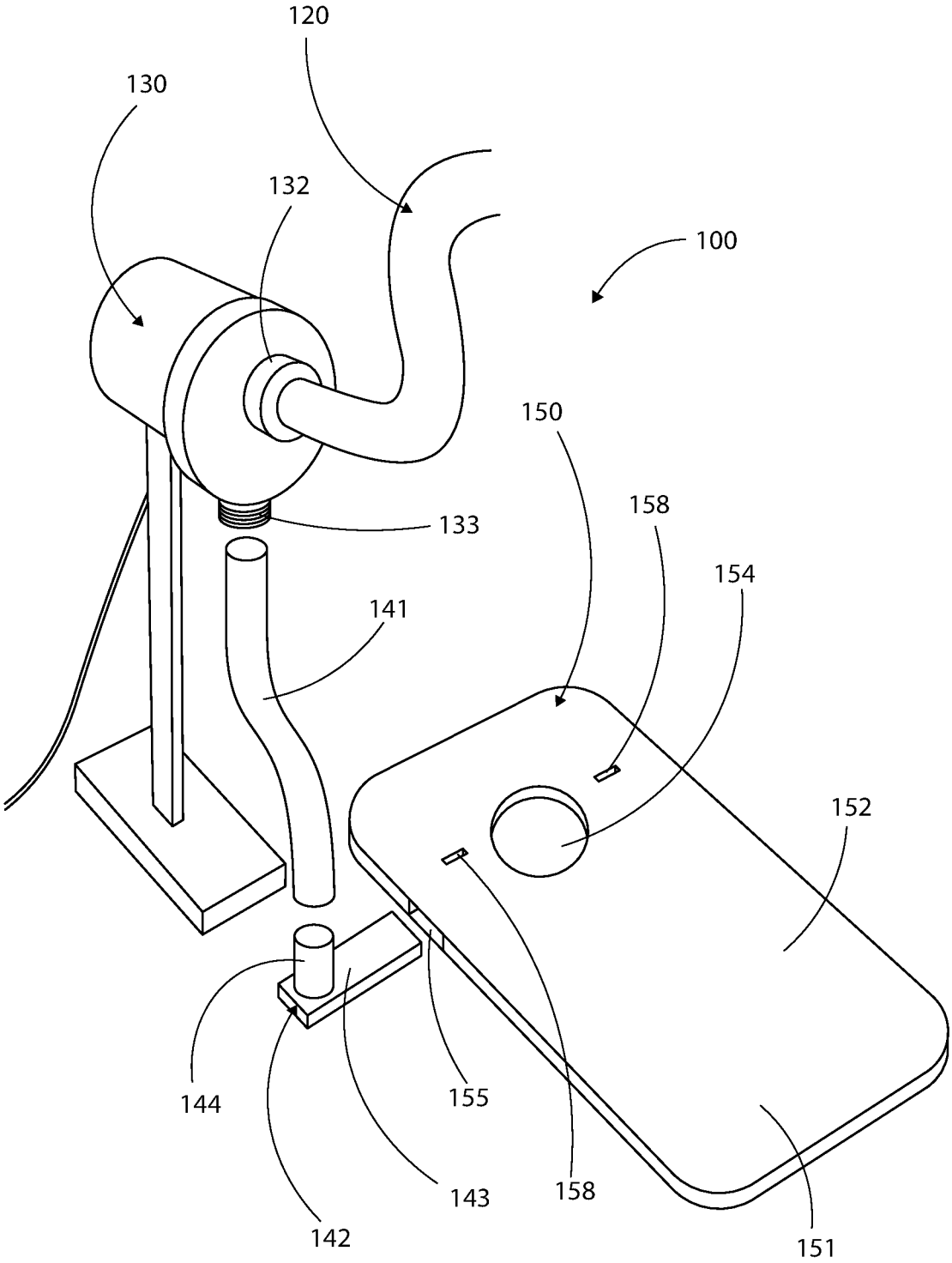
FIG. 4 is a partial exploded view of the odor removal system illustrating the pump unit, the second conduit assembly, and a base, according to an embodiment of the present disclosure.

In some embodiments, the pump unit 130 may further include a pump stand 134. Particularly, the pump stand 134 may include a stand base 135 and at least one stand arm 136 extending substantially perpendicular therefrom. The stand base 135 may be configured to attach to a surface about the toilet 5. For example, as shown in FIGS. 3-4, the stand base 135 may attach to a floor surface 15 adjacent the toilet 5. The at least one stand arm 136 may be configured to support the pump housing 131. For example, the at least one stand arm 136 may include a cradle configured to partially encompass the pump housing 131 of the pump unit 130. In some embodiments, the pump unit 130 may include a height of 360 mm, as measured from a bottom of the stand base 135 to a top of the pump housing 131.

Further, in some embodiments, a cover (not illustrated) may be provided for covering the pump unit 130, delivering a discrete, sleek and visually appealing appearance to the pump unit 130 and the odor removal system 100 as a whole. In other embodiments, the pump unit 130 may not include the pump stand 134 and instead may include a configuration that conforms and contours to the bowl 6 of the toilet 5.

To provide power to the pump 138, the pump unit 130 may include a plug for connection to a standard outlet 113 in a building (such as a 120 volt plug). In other embodiments (or in addition to this), the pump unit 130 may include a rechargeable battery (not illustrated). In some embodiments, the pump unit 130 may include a switch for turning the pump unit 130 on and off. Additionally, in some embodiments the pump unit 130 may include a sensor (not illustrated). The sensor may be configured to detect a user sitting on the toilet 5, and when presence is detected, the sensor may signal a controller (such as a microprocessor) in communication with the sensor and electrical circuitry of the pump unit 130 to actuate the pump unit 130. When the user leaves and the sensor does not detect presence after a period of time, the controller may switch the pump unit 130 off.

Figure 5:
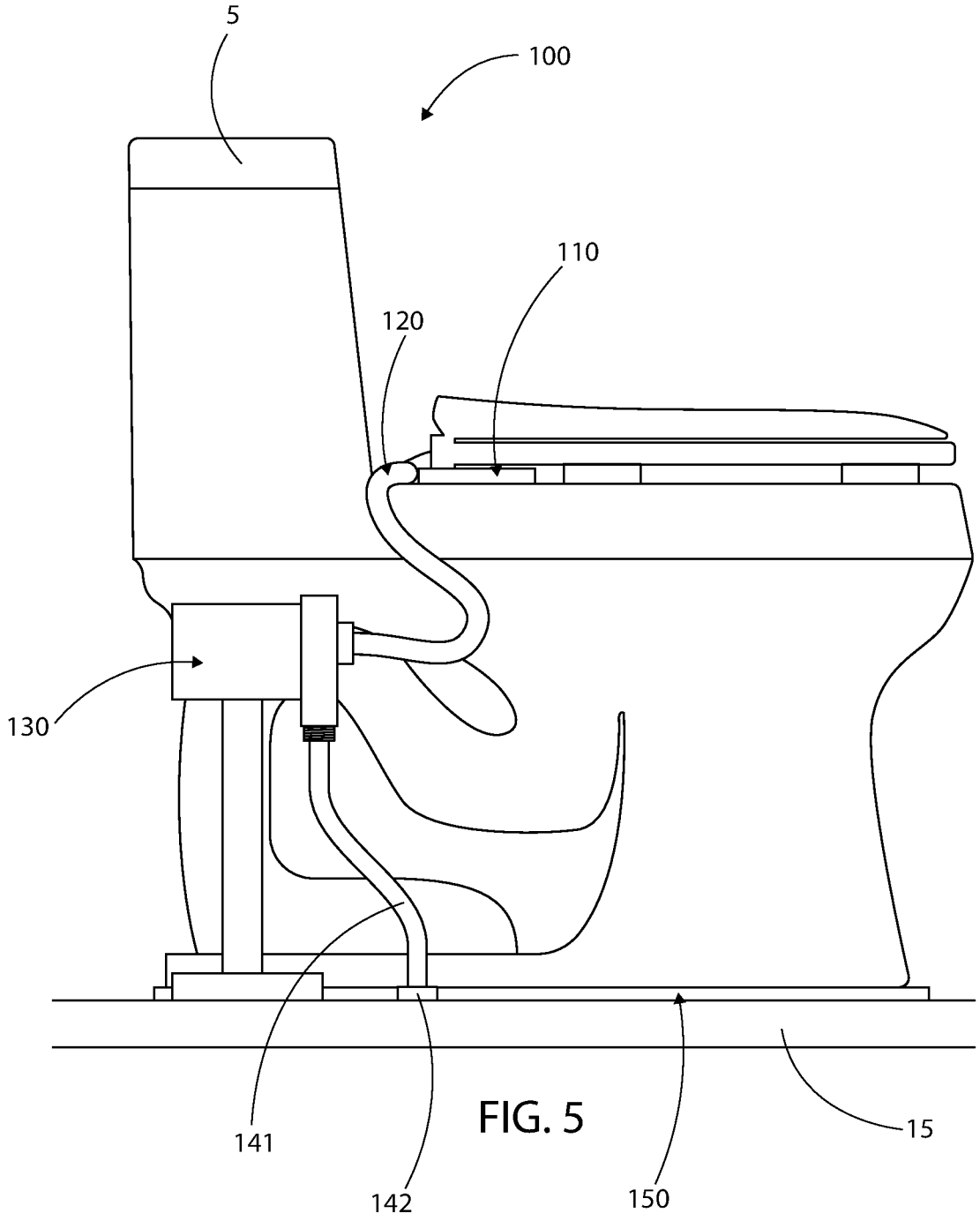
FIG. 5 is a side of the odor removal system attached to the toilet, according to an embodiment of the present disclosure.
Figure 6:
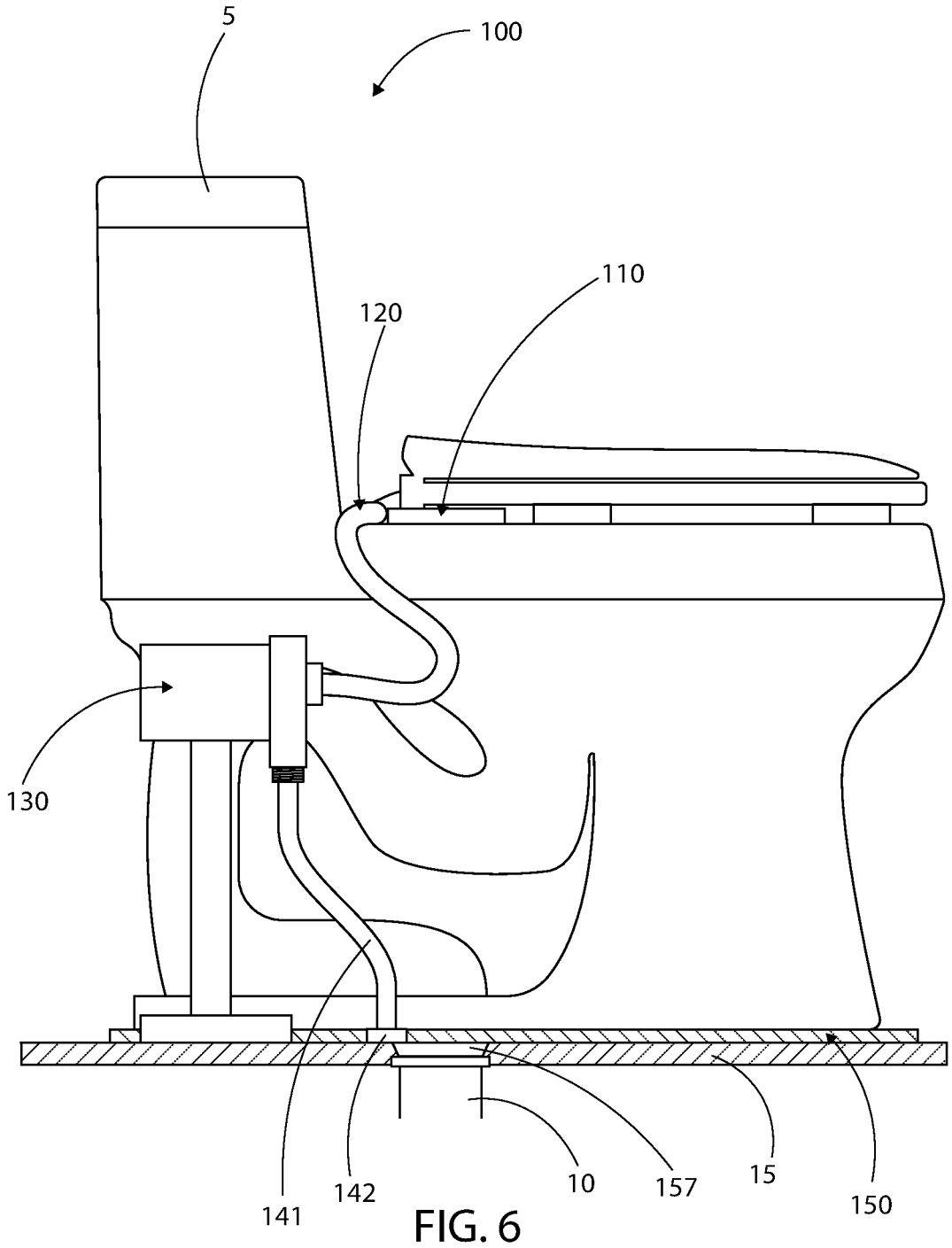
FIG. 6 is a partial cross-section view of the odor removal system of FIG. 5 illustrating the base attached atop a sewer drainpipe, according to an embodiment of the present disclosure.
Figure 7:
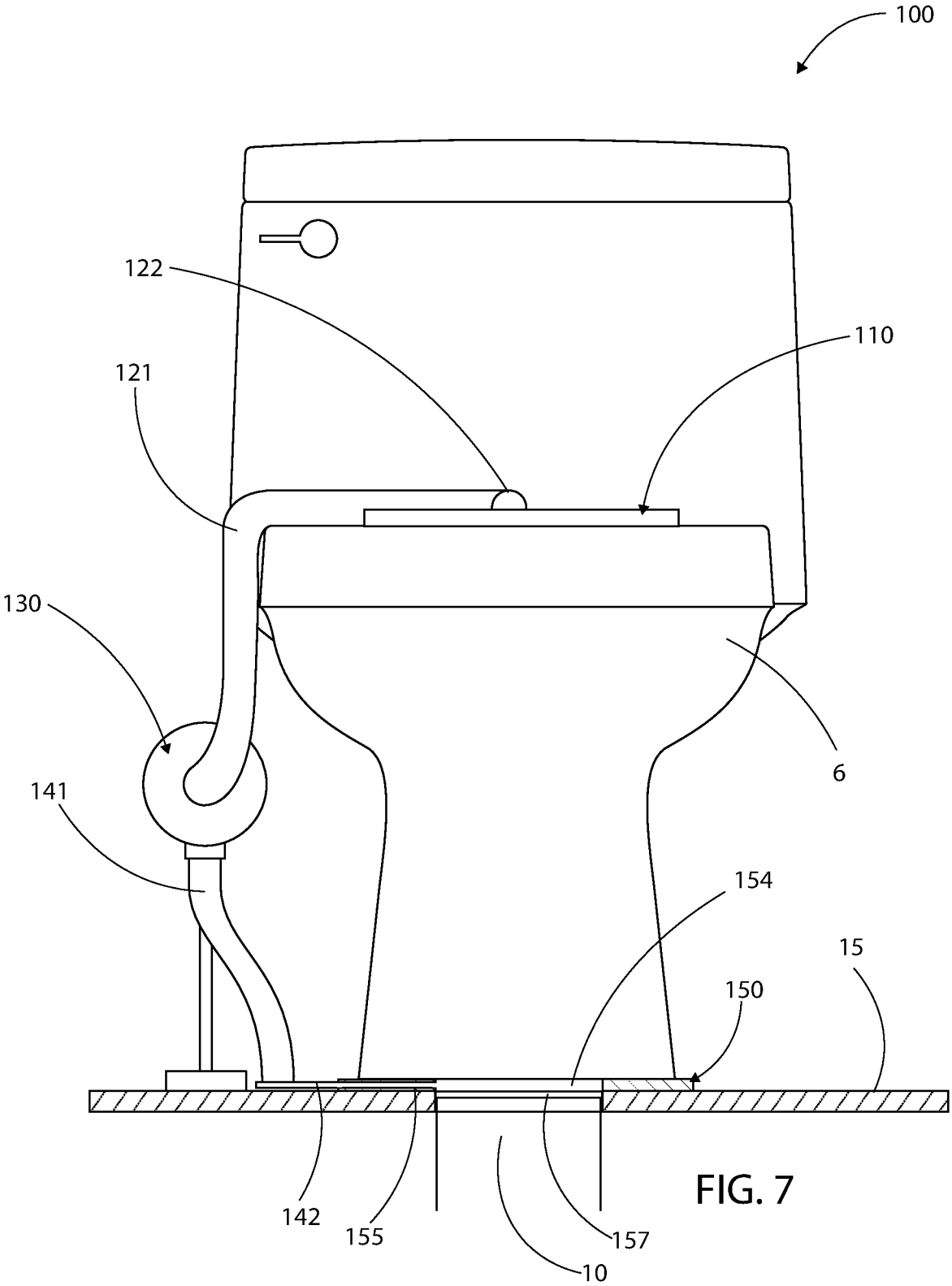
FIG. 7 is a partial cross-section view of the odor removal system of FIG. 6 illustrating a front view thereof, according to an embodiment of the present disclosure.
Figure 9:
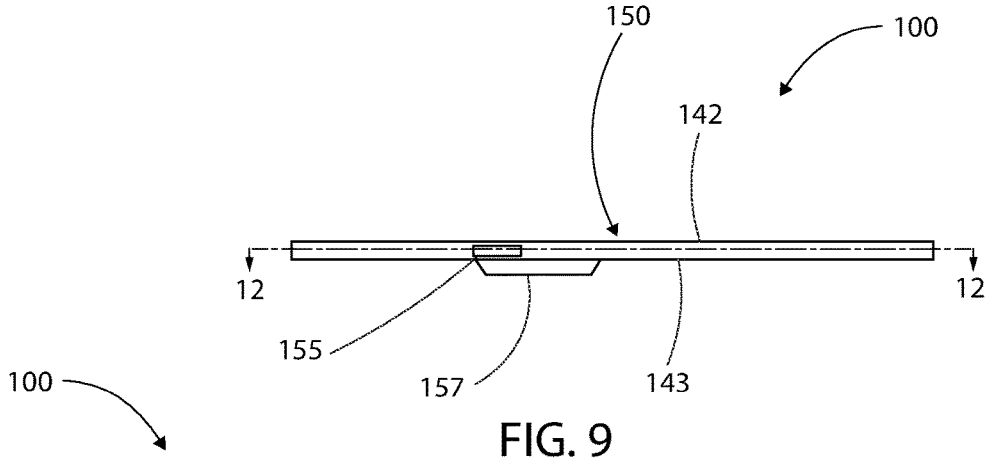
FIG. 9 is a side view of the base, according to an embodiment of the present disclosure.
Figure 10:
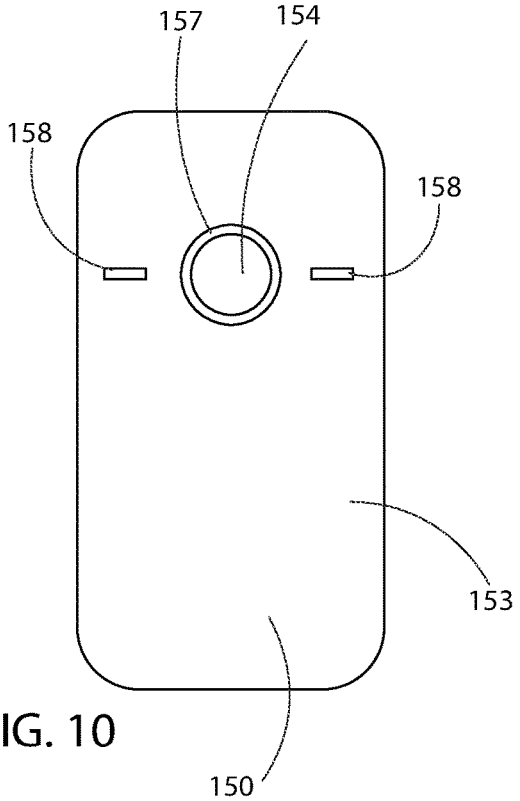
FIG. 10 is a bottom view of the base, according to an embodiment of the present disclosure.
Figure 8:
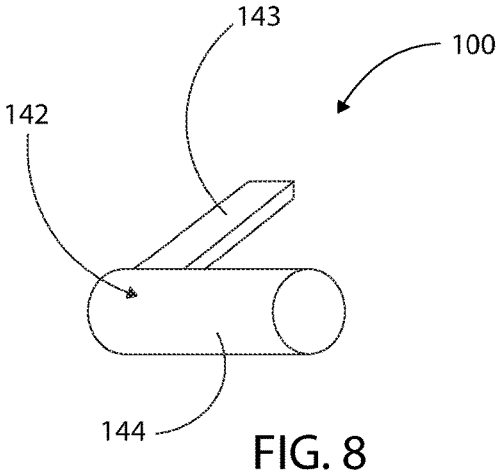
FIG. 8 is a perspective view of a second fitting, according to an embodiment of the present disclosure.
Figure 11:
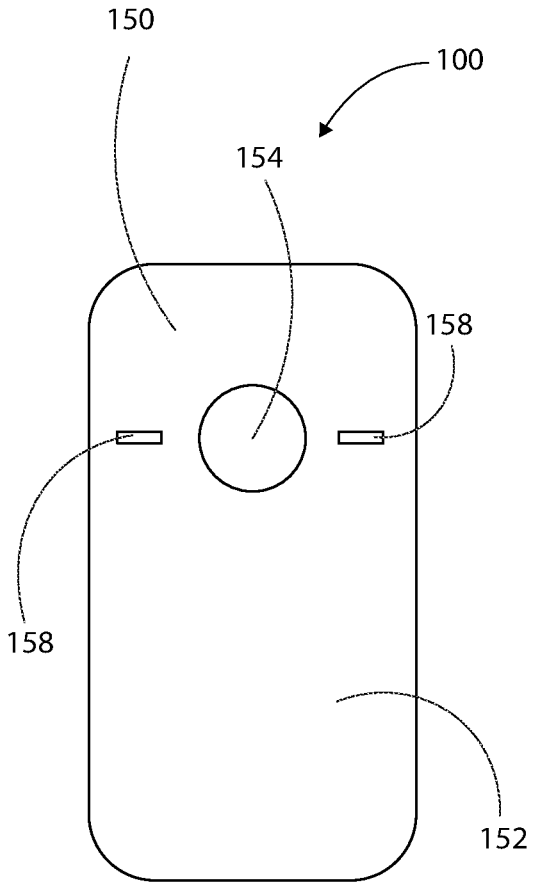
FIG. 11 is a top view of the base, according to an embodiment of the present disclosure.

As shown in FIG. 1, FIG. 3 and FIGS. 5-7, the base 150 may be configured for installation under a base of the toilet 5. For example, as shown in FIG. 4, the base 150 may include base bolt apertures 158 configured to receive bolts therein to attach the base 150 to the surface. For example, the base 150 may attach to the floor surface 15, as shown in FIGS. 5-7. When the base 150 is installed, the base bolt apertures 158 may also align with existing aperture on the base 150 of the toilet 5; and as such, bolts may be inserted through these toilet apertures and through the base bolt apertures 158, thereby attaching the toilet 5 to the base 150 and the toilet 5 and the base 150 to the floor surface 15.

Preferably, the base 150 may be made from a material able to withstand the weight of the toilet 5. Further, it should be appreciated that the base 150 is not limited to the configuration shown in these figures. For example, in some embodiments, the base 150 may include a shape and size equal to the base of the toilet 5, such that the base 150 does not protrude past the base of the toilet 5.

Further, as shown in FIGS. 4-7 and FIGS. 9-12, the base 150 may include a substantially flat body 151 having a top surface 152 opposite a bottom surface 153, a sewer pipe aperture 154, and an odor removal channel 155 disposed at a side of the base 150 and terminating at the sewer pipe aperture 154. The odor removal channel 155 may be configured for connection to the output 133 of the pump unit 130 via the second conduit assembly 140 such that the odor particles are directed through the odor removal channel 155. For example, as shown in FIGS. 4-7, the second conduit assembly 140 may be configured to connect to the output 133 of the pump unit 130 and convey the odor particles therefrom.

As shown in FIG. 4, the second conduit assembly 140 may include a second conduit 141 and a second fitting 142. In some examples, the first conduit 121 may include a diameter of 5 mm. The second fitting 142 may include a channel section 143 and a second conduit section 144. As shown, the second conduit section 144 may be configured for connection with the second conduit 141 (either via insertion, clips, etc.) and the channel section 143 may be configured for insertion into the odor removal channel 155. As such, the channel section 143 may guide the odor particles through the odor removal channel 155 and into the sewer pipe aperture 154. Further, similarly to the first conduit 121 above, the second conduit 141 may also be flexible and configured to conform to the bowl 6 of the toilet 5. The second fitting 142 may be provided in various configurations, enabling the second fitting 142 to be used with any toilet 5, any bathroom configuration, any toilet location, etc. For example, FIG. 4 demonstrates one embodiment of the second fitting 142, and FIG. 8 demonstrates another embodiment of the second fitting 142.

As shown in FIG. 7 particularly, the sewer pipe aperture 154 may be configured for installation in line with a sewer drainpipe 10 such that the odor particles directed through the odor removal channel 155 are expelled through the sewer pipe aperture 154 and down through the sewer drainpipe 10. In some embodiments, the sewer pipe aperture 154 may include a flange 157, as shown particularly in FIGS. 6-7 and FIGS. 9-10. The flange 157 may be attached about the bottom surface 153 of the base 150 (the bottom surface 153 being the surface in which contacts the surface when the base 150 is installed). The flange 157 may be similar to an existing flange on a standard toilet 5, enabling a sealer, such as a wax ring, to be attached around the flange 157 and thereby creating a watertight seal as usual for the toilet 5. As such, a top of the sewer pipe aperture 154 may include a diameter of 3⅞ inches to prevent the wax ring from falling down the sewer drainpipe 10. An interior section of the sewer pipe aperture 154 (as shown in FIG. 12) may include a diameter of 4 inches.

All elements discussed above, particularly the fittings and conduits, are preferably universal so as to fit any toilet 5. As such, it should also be appreciated that the configuration of the odor removal system 100 that is discussed here and shown in these figures is provided as an example and is not meant to limit the configuration of the odor removal system 100. For example, for toilets that are not attached to a floor surface, the base 150 may be attached to the wall. In this example, the base 150 may not attach underneath the toilet 5.

Figure 12:
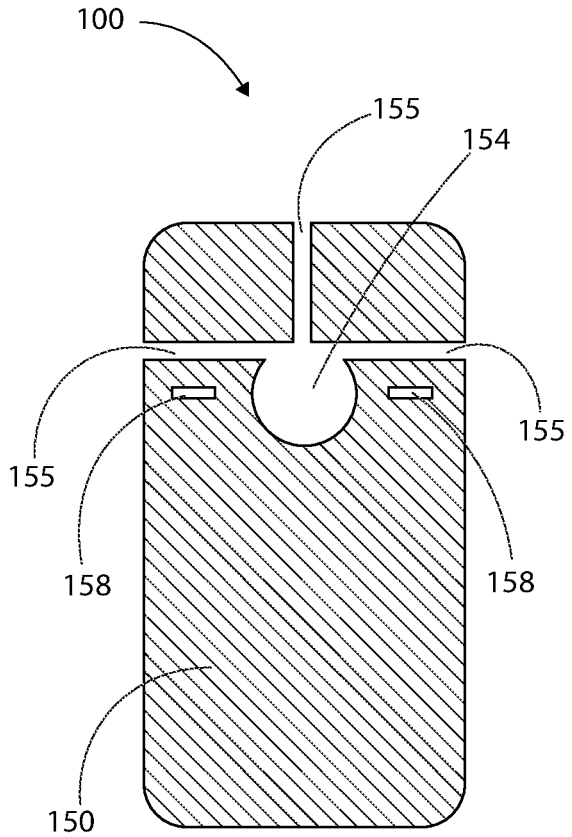
FIG. 12 is a cross-section view of the base taken from line 12-12 of FIG. 9 and illustrating a relationship between (at least one) odor removal channel and a sewer pipe aperture, according to an embodiment of the present disclosure.

Further, as shown in FIG. 12, in some embodiments, the base 150 may include more than one odor removal channel 155. This may enable the user to choose which odor removal channel 155 to use, based on best fit for their toilet 5. Once the correct odor removal channel 155 has been chosen, the user may fill in remaining odor removal channels. For example, one or more solid plugs may be provided for plugging each of the unused odor removal channels.

The odor removal system 100 may preferably be easily installable. For example, in some embodiments, a method of installing the odor removal system may include the steps of: installing the base 150 about the sewer drainpipe 10 (for example via a nut and bolt combination); inserting the second fitting 142 into the odor removal channel 155; attaching one end of the second conduit 141 to the second fitting 142; installing the toilet; installing the pump unit 130 about the toilet 5; attaching another end of the second conduit 141 to the output 133 of the pump unit 130; installing the odor intake unit 110 at the rear of the bowl 6 of the toilet 5; attaching the first fitting 122 to the outlet 113 of the odor intake unit 110; attaching one end of the first conduit 121 to the first fitting 122; attaching another end of the first conduit 121 to the inlet 112 of the odor intake unit 110; and powering the pump unit 130 to begin suctioning odor particles through the odor intake unit 110, out through the odor removal channel 155 and into the sewer drainpipe 10.

It should also be noted that, under appropriate circumstances, considering such issues as design preference, user preferences, marketing preferences, cost, structural requirements, available materials, technological advances, etc., other methods for installing the odor removal system are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

The invention claimed is:

1. An odor removal system for a toilet, the odor removal system comprising:

an odor intake unit including a main body having an inlet, an outlet and an odor intake channel therebetween, the odor intake unit configured for attachment about a rear of a bowl of the toilet such that odor particles are directed into the inlet;

a first conduit assembly configured to connect to the outlet of the odor intake unit and convey the odor particles therefrom;

a pump unit including a housing, a pump, an input and an output, the input configured for connection to the outlet of the odor intake unit via the first conduit assembly, the pump configured to move the odor particles in through the input and out through the output;

a second conduit assembly configured to connect to the output of the pump unit and convey the odor particles therefrom; and a base configured for installation under a base of the toilet, the base including a substantially flat body having a top surface opposite a bottom surface, a sewer pipe aperture, and an odor removal channel disposed at a side of the base and terminating at the sewer pipe aperture, the odor removal channel configured for connection to the output of the pump unit via the second conduit assembly such that the odor particles are directed through the odor removal channel, the sewer pipe aperture configured for installation in line with a sewer drainpipe such that the odor particles directed through the odor removal channel are expelled through the sewer pipe aperture and down through the sewer drainpipe.

2. The odor removal system of claim 1, wherein the first conduit assembly includes a first conduit and a first fitting, wherein the first fitting includes an intake section and a first conduit section, wherein the intake section is configured for connection with the outlet of the odor intake unit, wherein the first conduit section is configured for connection with the first conduit, and wherein the first conduit is configured for connection with the input of the pump unit.

3. The odor removal system of claim 2, wherein the second conduit assembly includes a second conduit and a second fitting, wherein the second fitting includes a channel section and a second conduit section, wherein the channel section is configured for insertion into the odor removal channel, and wherein the second conduit section is configured for connection with the second conduit.

4. The odor removal system of claim 3, wherein the first conduit and the second conduit are flexible.

5. The odor removal system of claim 4, wherein the pump unit further includes a pump stand, wherein the pump stand includes a stand base and at least one stand arm extending substantially perpendicular therefrom, wherein the stand base is configured to attach to a surface about the toilet, and wherein the at least one stand arm is configured to support the housing.

6. The odor removal system of claim 5, wherein the pump unit further includes a check valve.

7. The odor removal system of claim 6, wherein the check valve includes a ball and spring combination.

8. The odor removal system of claim 1, wherein the sewer pipe aperture includes a flange attached about the bottom surface of the base.

9. The odor removal system of claim 8, wherein the base further includes base bolt apertures configured to receive bolts therein to attach the base to the surface.

10. The odor removal system of claim 1, wherein the inlet is disposed at a front side of the main body, and wherein the outlet is disposed at a rear side of the main body.

11. The odor removal system of claim 10, wherein the front side includes an arcuate shape configured to conform to the bowl of the toilet.

12. The odor removal system of claim 11, wherein the inlet spans an entirety of the front side.

13. The odor removal system of claim 12, wherein the inlet includes a bottom lip configured to prevent inadvertent flow of water therethrough.

14. An odor removal system for a toilet, the odor removal system comprising:

an odor intake unit including a main body having an inlet disposed at a front side and spanning an entirety thereof, an outlet disposed at a rear side of the main body, and an odor intake channel therebetween, the odor intake unit configured for attachment about a rear of a bowl of the toilet such that odor particles are directed into the inlet;

a first conduit assembly configured to connect to the outlet of the odor intake unit and convey the odor particles therefrom, the first conduit assembly including a first conduit and a first fitting, the first fitting including an intake section and a first conduit section, the first conduit section configured for connection with the first conduit, the first conduit being flexible;

a pump unit including a housing, a pump, an input, an output and a check valve, the input configured for connection to the outlet of the odor intake unit via the first conduit assembly, the pump configured to move the odor particles in through the input and out through the output;

a second conduit assembly configured to connect to the output of the pump unit and convey the odor particles therefrom, the first conduit assembly including a second conduit and a second fitting, the second fitting including a channel section and a second conduit section, the second conduit section configured for connection with the second conduit, the second conduit being flexible; and a base configured for installation under a base of the toilet, the base including a substantially flat body having a top surface opposite a bottom surface, a sewer pipe aperture, and an odor removal channel disposed at a side of the base and terminating at the sewer pipe aperture, the odor removal channel configured for connection to the output of the pump unit via the second conduit assembly such that the odor particles are directed through the odor removal channel, the sewer pipe aperture configured for installation in line with a sewer drainpipe such that the odor particles directed through the odor removal channel are expelled through the sewer pipe aperture and down through the sewer drainpipe, the sewer pipe aperture including a flange attached about the bottom surface of the base.

15. The odor removal system of claim 14, wherein the pump unit further includes a pump stand, wherein the pump stand includes a stand base and at least one stand arm extending substantially perpendicular therefrom, wherein the stand base is configured to attach to a surface about the toilet, and wherein the at least one stand arm is configured to support the housing.

16. The odor removal system of claim 15, wherein the check valve includes a ball and spring combination.

17. The odor removal system of claim 14, wherein the base further includes base bolt apertures configured to receive bolts therein to attach the base to the surface.

18. The odor removal system of claim 14, wherein the front side of the main body includes an arcuate shape configured to conform to the bowl of the toilet.

19. The odor removal system of claim 18, wherein the inlet includes a bottom lip configured to prevent inadvertent flow of water through the inlet.

20. An odor removal system for a toilet, the odor removal system comprising:

an odor intake unit including a main body having an inlet disposed at a front side and spanning an entirety thereof, an outlet disposed at a rear side of the main body, and an odor intake channel between the inlet and the outlet, the odor intake unit configured for attachment about a rear of a bowl of the toilet such that odor particles are directed into the inlet, the front side of the odor intake unit including an arcuate shape configured to conform to the bowl of the toilet, the inlet including a bottom lip configured to prevent inadvertent flow of water through the inlet;

a first conduit assembly configured to connect to the outlet of the odor intake unit and convey the odor particles therefrom, the first conduit assembly including a first conduit and a first fitting, the first fitting including an intake section and a first conduit section, the first conduit section configured for connection with the first conduit, the first conduit being flexible;

a pump unit including a housing, a pump, an input, an output, a check valve, and a pump stand, the check valve including a ball and spring combination, the pump stand including a stand base and at least one stand arm extending substantially perpendicular therefrom, the stand base configured to attach to a surface about the toilet, the at least one stand arm configured to support the housing, the input configured for connection to the outlet of the odor intake unit via the first conduit assembly, the pump configured to move the odor particles in through the input and out through the output;

a second conduit assembly configured to connect to the output of the pump unit and convey the odor particles therefrom, the first conduit assembly including a second conduit and a second fitting, the second fitting including a channel section and a second conduit section, the second conduit section configured for connection with the second conduit, the second conduit being flexible; and a base configured for installation under a base of the toilet, the base including a substantially flat body having a top surface opposite a bottom surface, base bolt apertures configured to receive bolts therein to attach the base to the surface, a sewer pipe aperture, and an odor removal channel disposed at a side of the base and terminating at the sewer pipe aperture, the odor removal channel configured for connection to the output of the pump unit via the second conduit assembly such that the odor particles are directed through the odor removal channel, the sewer pipe aperture configured for installation in line with a sewer drainpipe such that the odor particles directed through the odor removal channel are expelled through the sewer pipe aperture and down through the sewer drainpipe, the sewer pipe aperture including a flange attached about the bottom surface of the base.

* * * * *